US006018221A

United States Patent [19]

Ohtake

[11] Patent Number: 6,018,221

[45] Date of Patent: Jan. 25, 2000

[54] LIGHTING CIRCUIT AND LIGHTING DEVICE

[75] Inventor: Hirokazu Ohtake, Kanagawa-ken, Japan

[73] Assignee: Toshiba Lighting & Technology Corporation, Tokyo, Japan

[21] Appl. No.: 09/292,672

[22] Filed: Apr. 16, 1999

[30] Foreign Application Priority Data

Apr. 16, 1998 [JP] Japan ..... 10-106205
Mar. 5, 1999 [JP] Japan ..... 11-58481

[51] Int. Cl.[7] ..... G05F 1/00

[52] U.S. Cl. ..... 315/307; 315/244; 315/209 R; 315/247; 315/DIG. 2; 363/34; 363/47

[58] Field of Search ..... 315/307, 244, 315/209 R, 207, 238, DIG. 2, DIG. 7, 247; 363/34, 44–47, 89, 98, 126, 132

[56] References Cited

U.S. PATENT DOCUMENTS 4,291,254 9/1981 Arlt et al. ..... 315/240
4,564,897 1/1986 Okamoto et al. ..... 363/132
5,691,605 11/1997 Xia et al. ..... 315/307
5,841,241 11/1998 Nilssen ..... 315/244

*Primary Examiner*—Haissa Philogene
*Attorney, Agent, or Firm*—Pillsbury Madison & Sutro LLP

[57] ABSTRACT

The present invention provides an improved power factor and lower harmonic distortion in the power supply circuit of a high frequency discharge lamp. An "extra" circuit path is provided so that the driving power to the lamp will "see" a load that significantly reduces the harmonic distortion and tends to cause the power factor to approach "1". In a preferred embodiment of the invention this is accomplished by providing a third capacitor with which the load circuit forms an in-series resonance circuit with the discharge lamp and its associated current-limiting inductance. The new circuit arrangement provides a high frequency current passage not provided in known lighting circuits of this type that raises the power factor and lowers harmonic distortion.

9 Claims, 17 Drawing Sheets

LIGHTING CIRCUIT AND LIGHTING DEVICE

INCORPORATION BY REFERENCE

This application claims priority from Japanese Patent Application 10-106205 filed Apr. 16, 1998 and 11-58481 filed Mar. 5, 1999, the contents of which are incorporated herein by reference.

BACKGROUND OF THE INVENTION

1. Field of the Invention

The present invention relates to high frequency lamps, and lighting devices using them including lighting circuits for driving the lamps.

2. Description of Related Art

High frequency discharge lamps, such as the fluorescent lamp are well known and popular. They are well known for their relatively cool temperature during operation, but they are not as efficient as desired and suffer from flickering.

Luminescence efficiency improves with the use of high frequency, the flickering of the brightness reduces the discharge lamp, and it is the lighting to the instant. Moreover, the lighting unit has become small and lightweight. However, early high frequency lighting circuits have a low power factor, and a problem of higher harmonic distortion of the lower frequency AC power supply. In order to solve this problem, there has been provided an inverter type power supply as described in Japanese Provisional Publication No. 4-193066. The arrangement described therein has the following circuit arrangement. A rectifier rectifies the AC power supply. A first capacitor smoothes the output of the rectifier through an inductor. An in-series circuit includes first and second switching devices connected in parallel with the first capacitor. A load circuit is connected through a second capacitor between the connecting point of the output end of the rectifier, and the inductor, and the connecting point of the first and second switching devices. The inductor shares the difference of the output voltage of the rectifier, and the voltage of the first smoothing capacitor. When the input voltage from the AC power supply is lower than the voltage of the first capacitor, input current flows. Higher harmonic distortion of input current is reduced, input current wave type is used as input voltage and the similar type, and the input power factor is improved. Inrush current near the peak value of power supply voltage is lowered by the inductor.

A switching power supply arrangement is shown in Japanese Provisional Publication No. 8-149816. The switching power supply has a bridge shaping circuit which rectifies the commercial power supply. The smoothing capacitor smoothes the output of the bridge shaping circuit. The switching element is intermittent in the voltage supplied from the smoothing capacitor. The intermittent switching output is supplied to the primary winding of the transformer. The switching power supply obtains the DC output from the secondary side of the insulating transformer. A low pass filter in the normal mode includes a filter choke coil and a filter capacitor is provided in the rectification current path of the bridge shaping circuit. The resonance capacitor is connected with the primary winding and forms the in-series resonance circuit. The total of the electrostatic capacity corresponding to the resonance capacitor and the electrostatic capacity forms the same first capacitor and two second capacitors. The first capacitor is connected to the output line of the bridge shaping circuit. The two capacitors are connected to the positive/negative input terminal of each bridge shaping circuit, respectively. The switching output from the primary winding is supplied to the bridge shaping circuit. In this switching power supply circuit, the total of the inductance of the primary winding of the insulating transformer and the electrostatic capacity of two second capacitors provides an in-series resonance which determines the oscillation frequency of the switching power supply circuit. The in-series resonance capacitor comprises one first capacitor and two second capacitors, and it connects with the bridge shaping circuit side. The switching output may be supplied to the shaping circuit side, and the power factor may be improved.

Another power supply arrangement, different from the first one described in the '066 publication is described in Japanese Provisional Publication No. 10-271848, published after the filing date of this application on which priority is claimed. A full wave rectifier rectifies the AC power supplied. A first smoothing is connected between the DC output ends of the full wave rectifier. First and second switching devices are connected to the first capacitor in parallel and ON/OFF is carried out at a frequency higher than that of the AC power supply. A pair of rectifiers are connected to the first and second switching devices in parallel, respectively. The in-series circuit of the second capacitor is connected to both ends of the AC power supply, and the third capacitor. The load circuit is connected between the connecting point of the first switching device and the second switching device, and the connecting point of the second capacitor and the third capacitor. A fourth capacitor is connected in parallel with at least one rectification device which comprises the full wave rectifier.

In the '066 publication, the high frequency concentrates and flows only to a pair of near diodes to which the load circuit is connected among the rectifiers by the side of the input. When there is much load current, the diodes experience a large temperature rise. Moreover, since load current flows to the inductor, in proportion to the current capacity of load, the inductor must be large. It becomes impossible to ignore power loss by the inductor. While power conversion efficiency falls after all, it is disadvantageous also from the small and lightweight viewpoint of equipment.

In the arrangement shown in the '816 publication, if the capacitor which resonates with the inductance comprises first and second capacitors when it is going to divert this to the lighting circuit temporarily, in order to start the discharge lamp, it is difficult to obtain necessary filament preheating and necessary secondary release voltages.

Furthermore, in the prior application, the fourth capacitor is connected in parallel with the rectification device which comprises the full wave rectifier. The voltage which the fourth capacitor applies becomes the value twice the route of the peak value of AC voltage. Since the capacitor with high voltage-proof needs to be used, it becomes expensive.

SUMMARY OF THE INVENTION

Accordingly, the present invention provides a lighting circuit which achieves a high power factor and moreover reduces higher harmonic distortion and a lighting device.

The present invention provides a third capacitor by which the load circuit forms an in-series resonance circuit to the discharge lamp, the current-limiting inductance, and high frequency. The fourth capacitor is connected so that the load circuit, and at least one side of the closed circuit of the first and second switching element may be formed. The fourth capacitor and the current-limiting inductance may carry out in-series resonance to the high frequency. Furthermore, the first and second capacitor are connected between AC input ends through the noise filter. By having connected the high frequency current passage between the point of the first and second capacitor connecting in-series and the load circuit, the lighting circuit is able to achieve a high power factor and low higher harmonic distortion.

Various embodiments of the invention will be described in detail with reference to the drawings.

BRIEF DESCRIPTION OF THE DRAWINGS

The invention will be described in more detail below with reference to the following Figures.

Throughout the various Figures, like reference numerals designate like or corresponding parts or elements. Duplicative description will be avoided as much as possible.

DETAILED DESCRIPTION OF THE PREFERRED EMBODIMENTS

Figure 1:
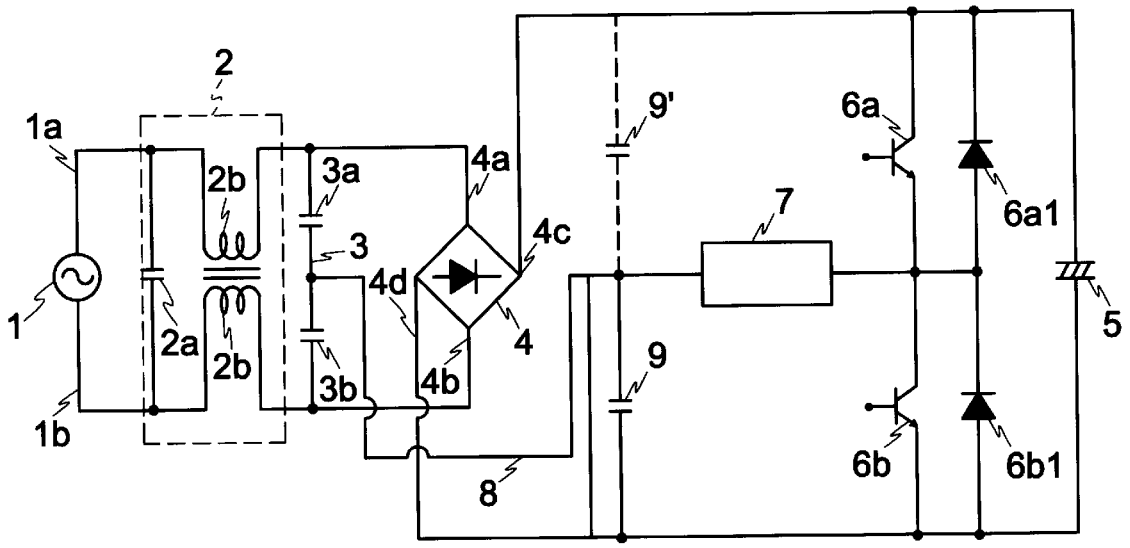
FIG. 1 is a circuit diagram of a first embodiment of a lighting circuit according to the invention.

The invention will be described in more detail below with reference to the following Figures:

FIG. 1 is a circuit diagram showing a first embodiment of the lighting circuit of the present invention. This circuit is intended for use with a low frequency (50–60 Hz.) commercial AC power supply 1. Of course, the invention is not limited to the use of typical commercial power. The circuits presented herein can be easily adapted by those of ordinary skill to operate with other types of power. A pair of AC terminals 1*a* and 1*b* tap into the commercial power. The commercial power is drawn through a noise filter 2 including a capacitor 2*a* in parallel with terminals 1*a* and 1*b* and a transformer 2*b*. The noise filter 2 prevents high frequency signals from flowing into the commercial AC power source.

One end of each winding of transformer 2*b* is connected to a respective side of capacitor 2*a*. A series coupled pair of capacitors 3*a* and 3*b* (generally of the same value, but not necessarily so) are connected across the output end of transformer 2*b* which is also connected to the AC input nodes of a full wave rectifier 4 having nodes 4*a*, 4*b*, 4*c* and 4*d*. A bridge shaping circuit can be used if desired. It is recommended that the full wave rectifier should use the high-speed recovery diodes.

DC output nodes 4*c* and 4*d* of rectifier 4 provide power to the discharge lamp, symbolized in the drawing by load circuit 7. A smoothing element 5 is connected across DC output nodes 4*c* and 4*d*. Smoothing element 5 can be only a capacitor or a more complex smoothing circuit. Smoothing element 5 should smooth most of the pulse-like output of rectifier 4.

Switching elements 6*a* and 6*b*, in series with each other and together across nodes 4*c* and 4*d* are driven by circuits not shown to alternately open and close. This provides the high frequency power needed to discharge lamp 7*a*. Diodes 6*a*1 and 6*b*1 are connected across switching elements 6*a* and 6*b*, respectively. These diodes are connected with opposite polarity to their respective switching elements. Switching elements 6*a* and 6*b* are preferably bipolar transistors or FETs. If bipolar transistors are used, the associated diode is connected in reverse polarity to the emitter-collector junction of the bipolar transistor. Wired in circuit in this manner, diodes 6*a*1 and 6*b*1 will tend to pass any high frequency oscillator currents that may be established. However, if FETs are used for elements 6*a* and 6*b*, it is not necessary to provide reverse polarity diodes 6*a*1 and 6*b*1 because the FETs have parasitic diodes formed within them. If desired, an inductor can be applied across smoothing element 5.

Figure 2:
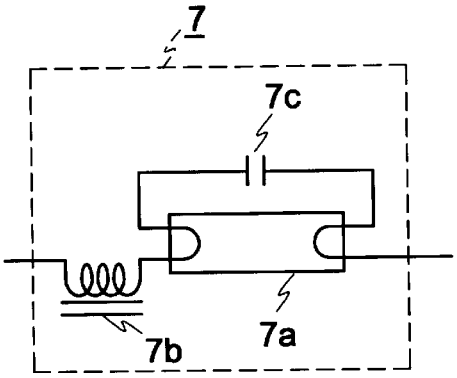
FIGS. 2–4 are various embodiments of load circuit 7 shown in FIG. 1.
Figure 3:
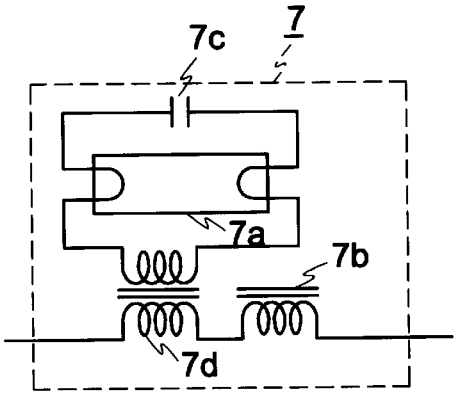
Figure 4:
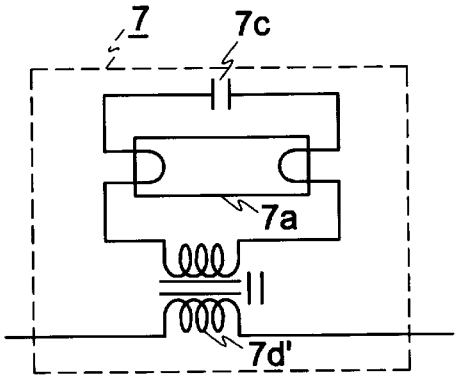

Alternative arrangements of load circuit 7 are shown in FIGS. 2–4. Load circuit 7 includes a discharge lamp 7*a*, a current-limiting inductor 7*b*, and a capacitor 7*c*. Discharge lamp 7*a* and current-limiting inductance 7*b* are connected in series. Inductor 7*b* and capacitor 7*c* form an in-series resonance circuit for high frequency.

Load circuit 7 is driven by the high frequency produced by the switching of elements 6*a* and 6*b* connected in series. Therefore, one end of load circuit 7 is connected to the node joining switching elements 6*a* and 6*b*. The series resonance circuit formed by inductor 7*b* and capacitor 7*c* help to provide a high voltage to lamp 7*a* when it needs to be started.

The FIG. 2 arrangement of load circuit 7 includes current-limiting inductor 7*b*, discharge lamp 7*a* and capacitor 7*c*. The use of capacitor 7*c* provides for filament heating before start up. After the lamp has started and lamp current lowers, filament heating by capacitor 7*c* decreases. Filament heating after starting is mainly maintained by discharge current. The FIG. 3 load circuit 7 arrangement differs from the one shown in FIG. 2 in that it includes a inductor 7*d*. One winding of inductor 7*d* is connected in series with inductor 7*b*. A second winding of inductor 7*d* is connected across lamp 7*a*.

The FIG. 4 arrangement of load circuit 7 includes inductor 7*d*' but does not include a separate current limiting inductor 7*b*. Inductor 7*d*' effectively acts as current-limiting inductor 7*b*.

Referring once again to FIG. 1, notice the circuit connection between load circuit 7 and the junction of capacitors 3*a* and 3*b*. This connection between capacitors 3*a* and 3*b* and through load circuit 7 provides a high frequency current passage 8. This high frequency current passage 8 enhances the power factor of the operation of the lighting circuit and reduces the harmonic distortion of the power signal by providing a direct path for high frequency current to the low frequency AC power supply side. As used herein high frequency refers to 1–200 kHz. and usually to the range of 20–200 KHz.

A capacitor 9 is connected so that the load circuit 7 and switch 6*b* form a closed circuit. Another capacitor 9' can be connected "opposite" to capacitor 9 so that load circuit 7 can form a complete circuit with switch 6*a*. Capacitor 9' can be optionally provided to mitigate the capacitance of capacitor 9.

Capacitor 9 forms a series resonance circuit with the current-limiting inductance of load circuit 7 for the high frequency voltage. Such a resonance circuit can be formed with either or both of switches 6*a* and 6*b* using either or both capacitors 9 and 9'.

Operation of the first embodiment, shown in FIG. 1 will now be explained. Smoothing element 5 smooths the rippled DC output of full wave rectifier 4 and charges to a substantially smooth DC voltage.

A half bridge type inverter circuit is formed by the switching of switching elements 6*a* and 6*b*. This causes a high frequency voltage to appear across capacitor 9 which resonates at high frequency. A high frequency substantially sine wave form is generated. Capacitors 3*a*, 3*b* and 9 form an AC voltage divider. Thus a high frequency oscillating voltage is superimposed on the low frequency AC power supply voltage at capacitor 9. Consequently, a high frequency oscillating voltage appears in the upper and lower sides based on low frequency AC power supply voltage as standard voltage. Then, smoothing element 5 supplies the falling portion of the sine wave.

A second high frequency current is supplied to load circuit 7 through direct high frequency current passage 8 from the low frequency AC power supply 1 in the standup term separated from the standard voltage of high frequency oscillating voltage.

The first and second high frequency currents are superimposed, and high frequency current having a substantially sine wave flows through load circuit 7. The first high frequency current constitutes the first half of a sine wave and the second high frequency current constitutes the second half of a sine wave. Together, they form a substantially complete sine wave.

The magnitude of the high frequency current that flows through load circuit 7 is proportional to the instantaneous value of the low frequency AC voltage (each half wave of low frequency AC voltage). For this reason, input current from which the high frequency ingredient was removed by noise filter 2 serves as a low frequency AC voltage in-phase.

Load circuit 7 has a high frequency resonance circuit including inductor 7*b* and capacitor 7*c* in addition to discharge lamp 7*a*. The starting of discharge lamp 7*a* is controllable. The input current to lamp 7*a* is substantially a sine wave, as already described. For this reason higher harmonic distortion decreases.

A portion of the second high frequency current which flows indirectly becomes a charging current for smoothing element 5 from the low frequency AC power supply 1. For this reason, charging current (each half-cycle of low frequency AC voltage) flows substantially constantly. Therefore inrush current does not occur at the time of charging. However, when only the smoothing capacitor comprises the smoothing element 5, the capacitor charges only during a few phase intervals near the peak value of low frequency AC voltage. Few ripples are formed in input current wave type. Also in this case, the input current wave type is substantially a sine wave.

The use of a resonance circuit causes the input current to be substantially a sine wave. At the time of starting of lamp 7*a*, the high voltage by resonance is applied and starting is facilitated. Capacitor 7*c* can also help with filament heating.

FIGS. 5–10 are schematic diagrams explaining the operation of the lighting circuit shown in FIG. 1. In particular, these figures explain how capacitors 9 and 9' are connected and utilized.

Figure 5:
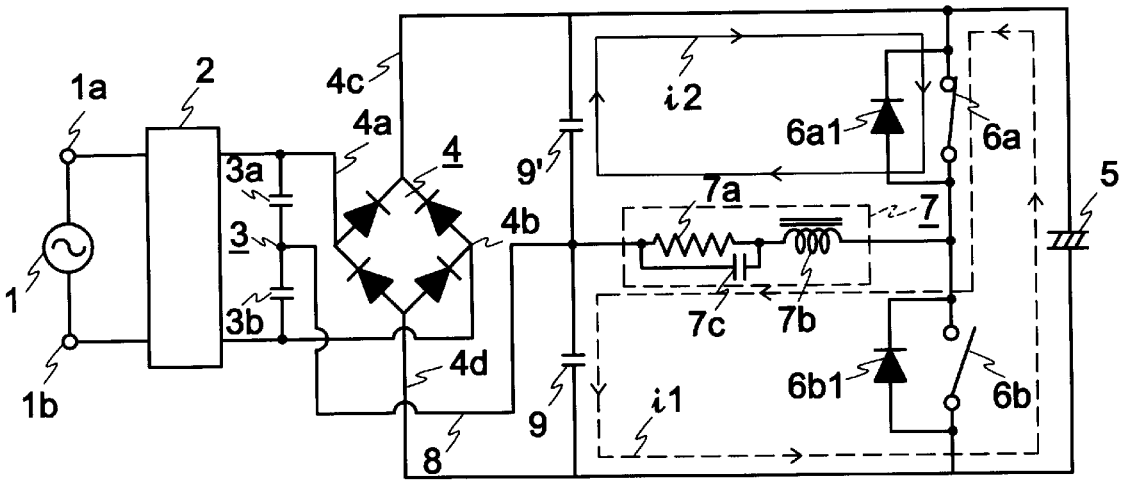
FIGS. 5–10 show various states of the lighting circuit of FIG. 1 during operation.

FIG. 5 shows the state of the circuit at a point in time when switching element 6*a* turns on. Smoothing element 5 is discharging through a circuit path including closed switching element 6*a*. High frequency current i1 flows in the circuit path defined by smoothing element 5, first switching element 6*a*, load circuit 7 and capacitor 9. Consequently, capacitor 9 is charged. Simultaneously capacitor 9' discharges. High frequency current i2 flows in a circuit path defined by capacitor 9', first switching element 6*a*, and load circuit 7. High frequency currents i1 and i2 both flow through load circuit 7 forming a plus pole 'standup' current. The high frequency power supply current in this case is essentially from the charge of smoothing element 5. When this high frequency current flows, capacitors 9 and 9' provide in-series resonance circuits with current-limiting inductor 7*b* of the load circuit 7. Current-limiting inductor 7*b* and capacitor 7*c* also provide a series resonance circuit path. The current flowing is substantially a sine wave.

Figure 6:
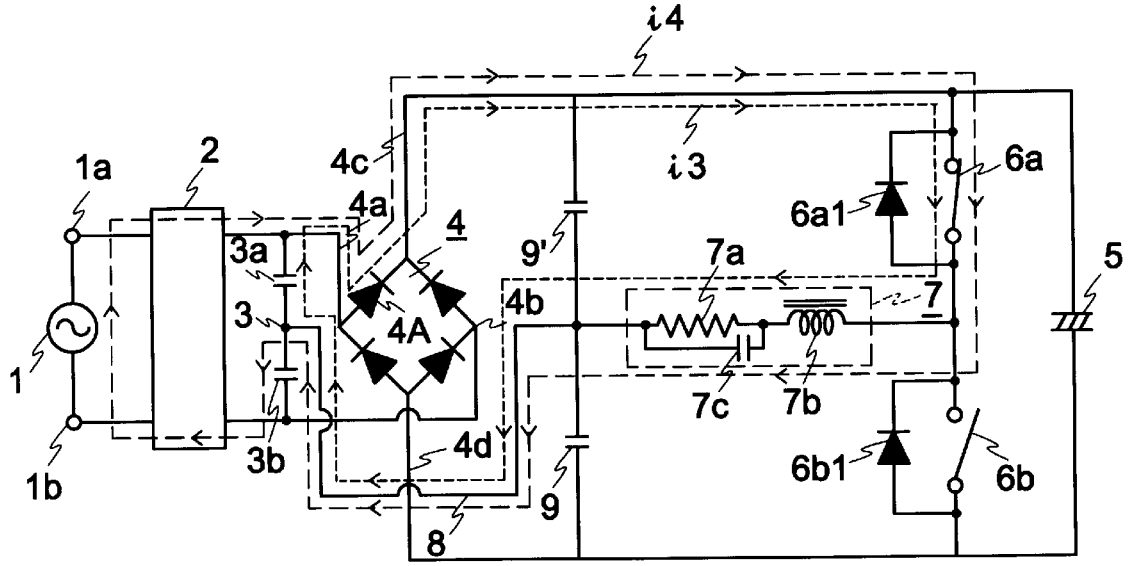

FIG. 6 shows the state of the circuit during the ON state of first switching element 6*a*. Capacitor 3*a* is discharging. High frequency current i3 flows via capacitor 3*a*, diode 4*a*, switching element 6*a*, load circuit 7, and high frequency current passage 8. Simultaneously high frequency current i4 flows in a path defined by low frequency AC power supply 1, noise filter 2, diode 4*a*, switching element 6*a*, load circuit 7, high frequency current passage 8, and capacitor 3*b*.

Figure 7:
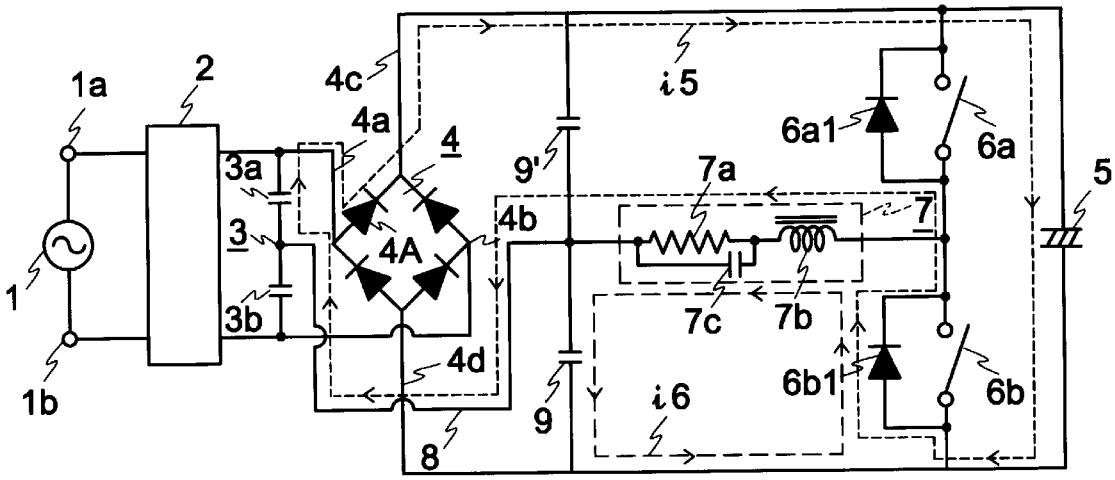

FIG. 7 shows the state when switching elements 6*a* and 6*b* are OFF simultaneously. In this state capacitor 3*a* discharges. High frequency current i5 flows through diode 6*b*1 (reverse parallel to switching element 6*b*), load circuit 7, high frequency current passage 8, capacitor 3*a*, diode 4A, and smoothing element 5. The smoothing element 5 charges. Simultaneously, capacitor 9 discharges. High frequency current i6 flows in the circuit path defined by capacitor 9, diode 6*b*1 (reverse parallel to switching element 6*b*), and load circuit 7.

The current which flows through load circuit 7 forms the portion of the falling of the plus pole nature of high frequency current. The power supply of high frequency current in this case is the low frequency AC power supply 1 fundamentally, and high frequency current is directly supplied to the load circuit 7 through the high frequency current passage 8 through capacitor 3*a* from the low frequency AC power supply 1. Moreover, high frequency current becomes substantially a sine wave due to resonance.

Figure 8:
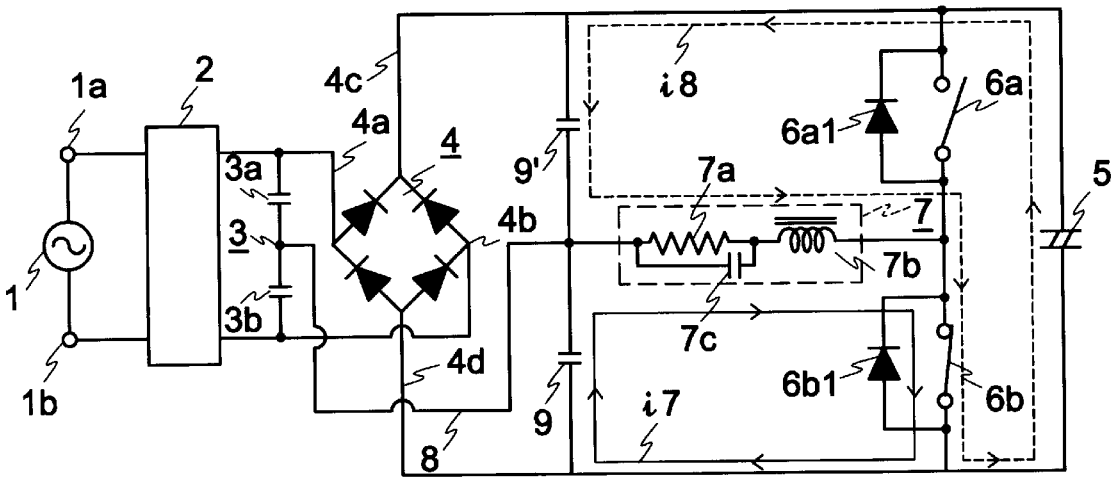

FIG. 8 shows the circuit state when the switches reverse and switching element 6*b* turns on, and switching element 6*a* turns OFF. Capacitor 9 discharges. High frequency current i7 flows in a circuit path defined by capacitor 9, load circuit 7, and switching element 6*b*. Smoothing element 5 discharges simultaneously. High frequency current i8 flows in a circuit path defined by smoothing element 5, capacitor 9', load circuit 7, and switching element 6*b*. Consequently, capacitor 9' charges.

The current which flows through load circuit 7 forms the minus pole standup portion of high frequency current. The power supply of high frequency current in this case is from the charge of smoothing element 5 fundamentally. The high frequency current becomes a sine wave for the same reason as explained above.

Figure 9:
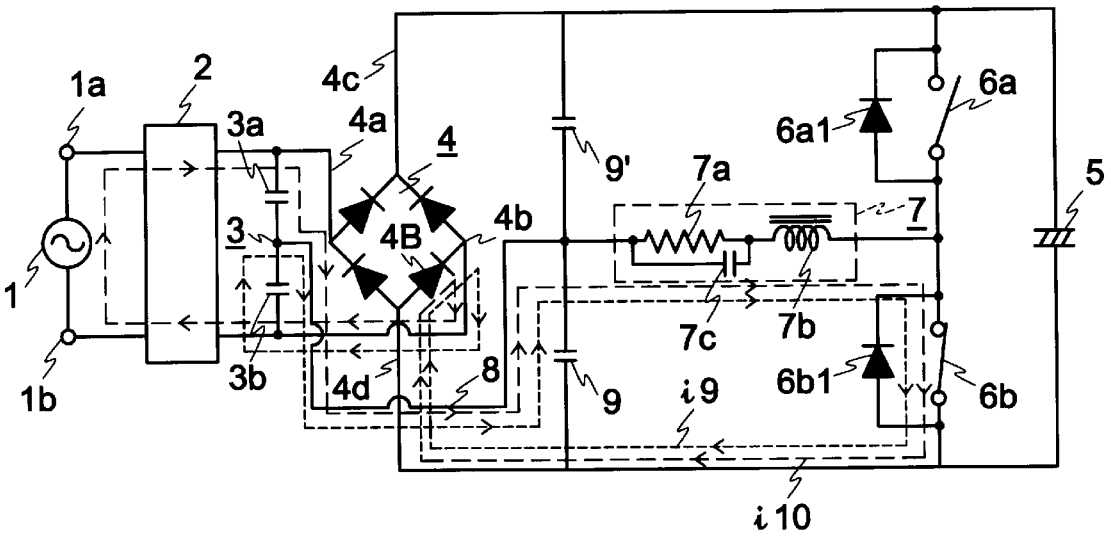

FIG. 9 shows the state where switching element 6*b* is ON, and capacitor 3*b* is discharging. High frequency current i9 flows in a circuit path defined by capacitor 3*b*, high frequency current passage 8, load circuit 7, switching element 6*b*, and diode 4B. Simultaneously, high frequency current i10 flows in a circuit path defined by noise filter 2, high frequency current passage 8, load circuit 7, switching element 6*b*, diode 4B, and low frequency AC power supply 1.

Figure 10:
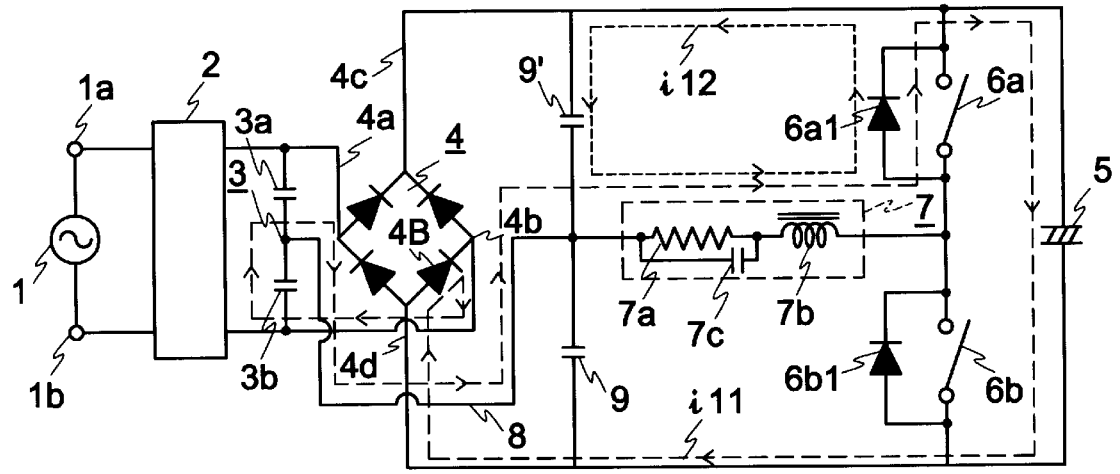

FIG. 10 shows the circuit state when both switching elements 6*b* and 6*a* are OFF simultaneously. Capacitor 3*b* discharges. High frequency current i11 flows in a circuit path defined by capacitor 3*b*, high frequency current passage 8, load circuit 7, diode 6*a*1, smoothing element 5, and diode 4B. Capacitor 3*b* charges smoothing element 5. Capacitor 9' discharges simultaneously. High frequency current i12 flows in a circuit path defined by capacitor 9', load circuit 7, and diode 6*a*1. The current which flows through load circuit 7 forms the falling minus pole portion of high frequency current. The power supply of high frequency current in this case is the low frequency AC power supply 1 fundamentally. High frequency current is directly supplied to load circuit 7 through high frequency current passage 8. Moreover, this high frequency current is substantially a sine wave.

Figure 11:
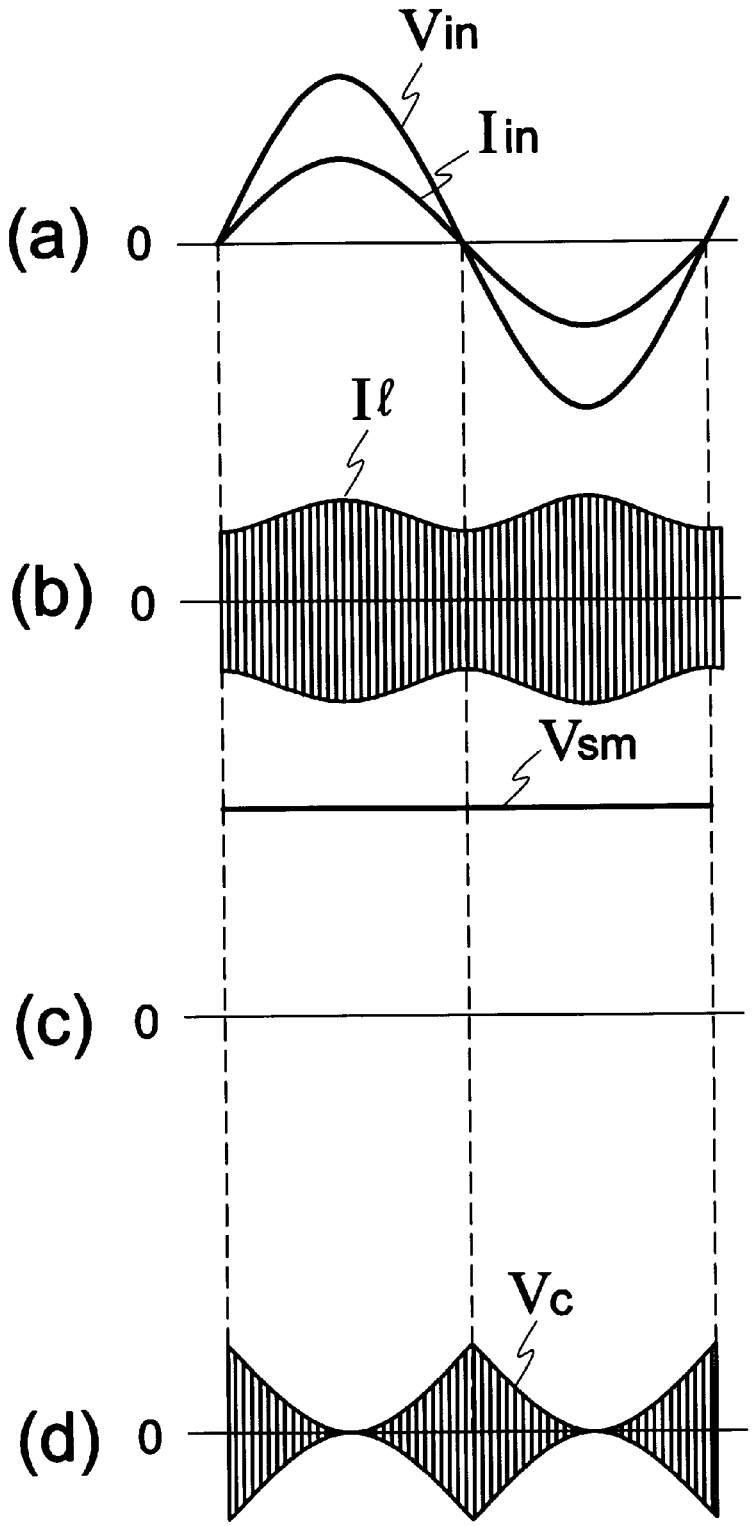
FIG. 11 is a wave form chart explaining the operation of the first embodiment of the lighting circuit.

FIG. 11 (including lines (a), (b), (c) and (d)) includes wave forms showing various voltages and currents explaining the operation of the circuit of FIG. 1. Line (a) shows the low frequency AC power supply voltage Vin and the wave form of input current Iin. Line (b) is the wave form of lamp current I1. Line (c) is the wave form of the voltage Vsm of smoothing element 5. Line (d) is the wave form of the voltage Vc of capacitor 9. The input current Iin is a sine wave. The low frequency AC power supply voltage Vin is in-phase with the input current Iin. Current flows for substantially the entire cycle. Therefore, in the present invention, with very little high frequency distortion, the power factor is. substantially 1 which means that the circuit operates with high efficiency.

Figure 12:
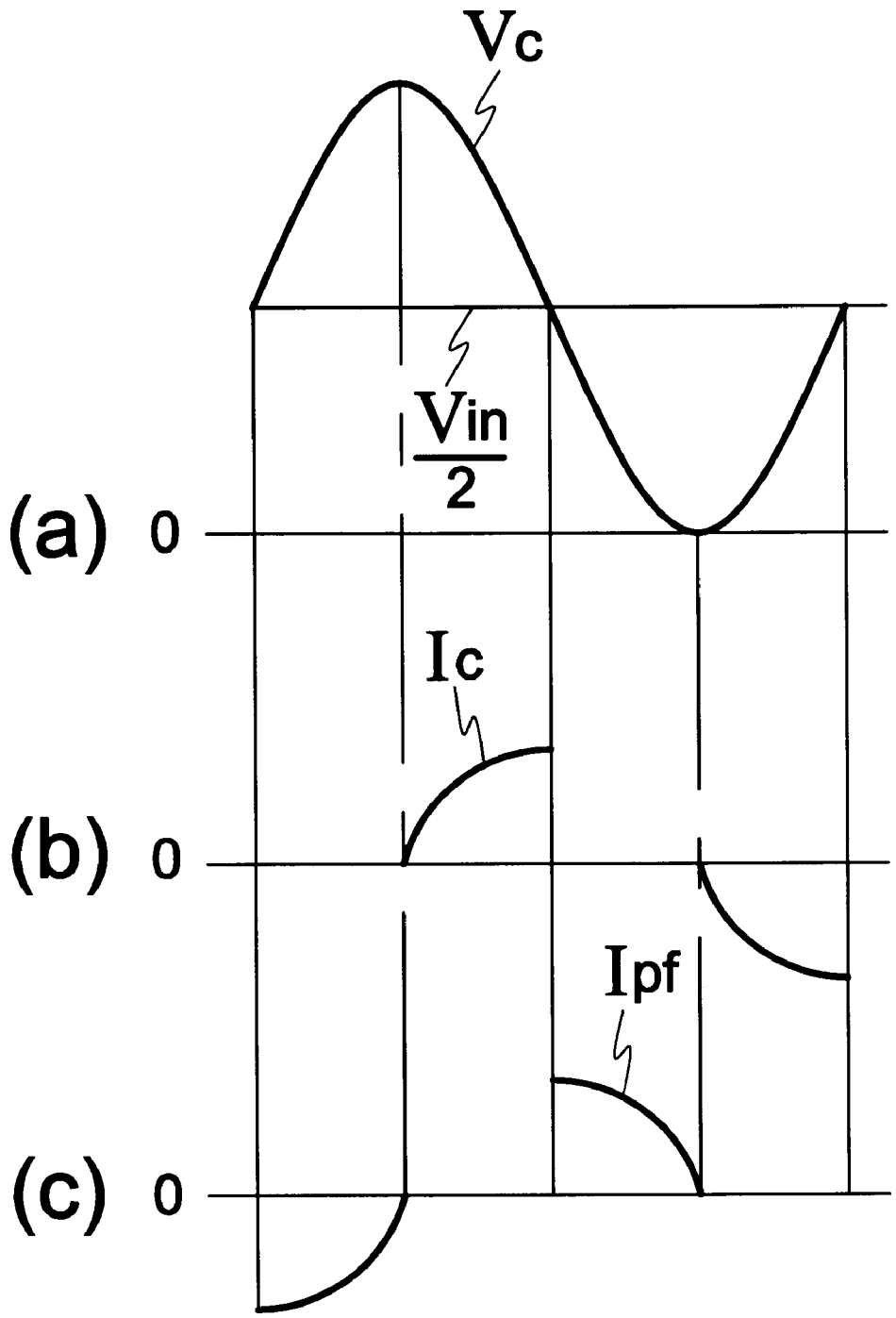
FIG. 12 is a wave form chart explaining the operation of the first embodiment of the lighting circuit.

FIG. 12 is a wave form chart explaining in greater detail about the high frequency operation of the lighting circuit of FIG. 1. Line (a) represents voltage Vc of capacitor 9. Also shown in line (a) is voltage Vin/2 which is one half of the value of the low frequency AC power supply voltage Vin. It is the voltage which appears at the connecting point of capacitors 3*a* and 3*b*. Since this voltage is low frequency, it is visible to the DC. Line (b) represents current Ic which flows in capacitor 9. Line (c) represents current Ipf which flows in the high frequency current passage. High frequency current which flows at the times shown in FIGS. 5 and 8 is represented by line (b), and high frequency current which flows at the times shown in FIGS. 6, 7, 9, and 10 is shown in line (c).

Figure 13:
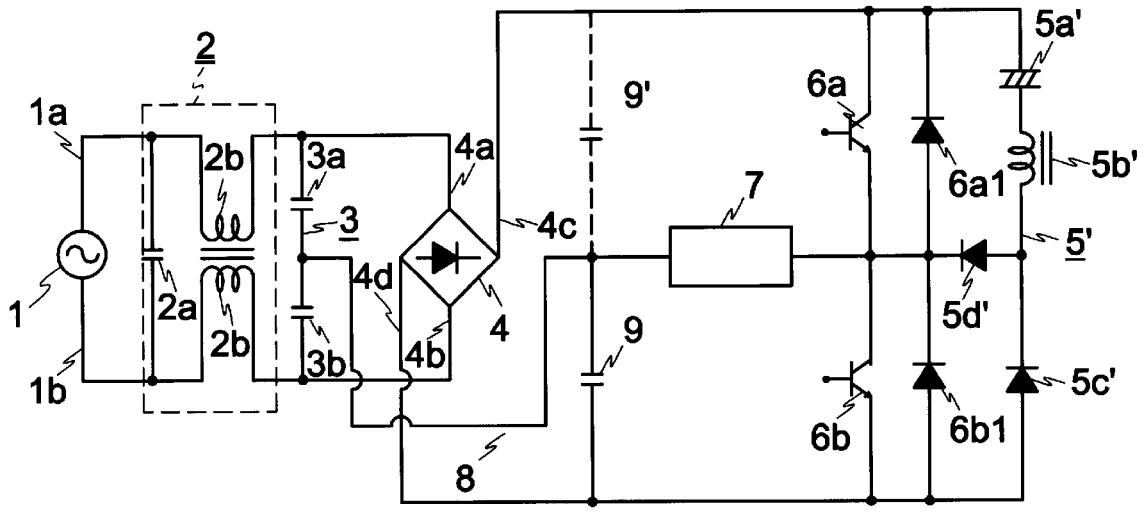
FIG. 13 is a circuit diagram showing a second embodiment of a lighting circuit of the present invention.

FIG. 13 is a circuit diagram showing the second embodiment of the lighting circuit of the present invention. Corresponding elements, already explained with respect to the first embodiment will not be further explained. The second embodiment differs from the first in that smoothing element 5 of the first embodiment is replaced by a smoothing circuit 5'. Smoothing circuit 5' includes a series circuit of diode 5*c*' of reverse polarity to a smoothing capacitor 5*a*', an inductor 5*b*', and a diode 5*d*' for connecting smoothing capacitor 5*a*' and inductor 5*b*' to switching element 6*b*.

The smoothing circuit 5' acts so that switching element 6*a*, diode 5*d*', inductor 5*b*', and smoothing capacitor 5*a*' together form a step-down chopper which generates high frequency and fills in voltage when the DC voltage of rectifier 4 is lower than the terminal voltage of smoothing capacitor 5*a*'.

For this embodiment, the smoothing element comprises the smoothing circuit 5'. When the instantaneous value of the DC output voltage of the low frequency full wave rectifier is higher than the terminal voltage of the smoothing capacitor, the partial smoothing circuit drives as a step-down chopper and there is no inrush current to the smoothing capacitor in the peak part of low frequency AC voltage. The input current wave becomes much more close to a pure sine wave and higher harmonic distortion decreases.

Figure 14:
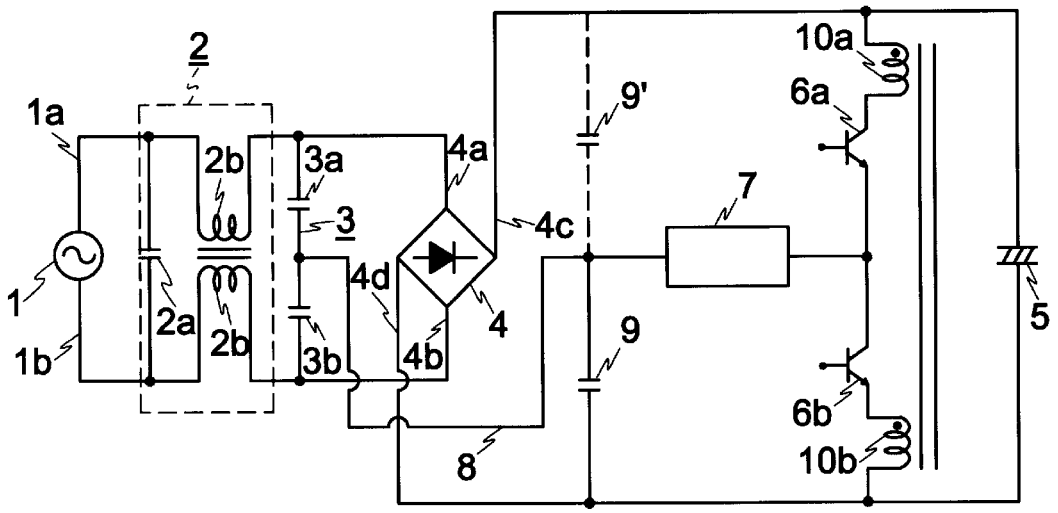
FIG. 14 is a circuit diagram showing the third embodiment of a lighting circuit of the present invention.

FIG. 14 is a circuit diagram of a third embodiment of the lighting circuit of the present invention. In this embodiment switching elements 6*a* and 6*b* are connected in series with respective inductors 10*a* and 10*b*. Inductors 10*a* and 10*b* are magnetically coupled to each other. The switching of switching elements 6*a* and 6*b* creates a push-pull driving arrangement.

Figure 15:
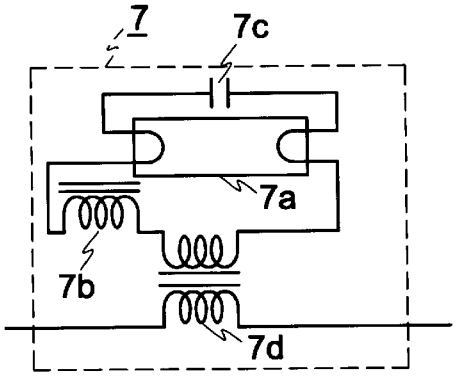
FIGS. 15–17 show alternative circuit arrangements of load circuit 7.
Figure 16:
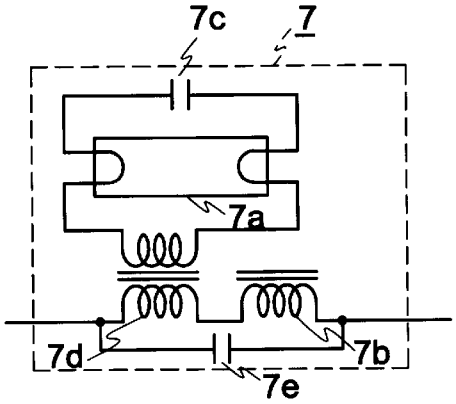
Figure 17:
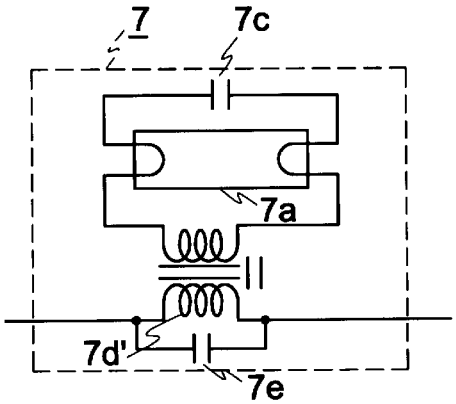

FIGS. 15–17 show alternative arrangements of load circuit 7. The load circuit 7 arrangement shown in FIG. 15 differs from the one shown in FIG. 2 because of the addition of a choke coil inductor 7*d*. The load circuit 7 of FIG. 16 differs from the one shown in FIG. 3 in the parallel arrangement of inductor 7*d*. The load circuit 7 of FIG. 16 differs from the one shown in FIG. 3 in that there is included a capacitor 7*e* in parallel with current-limiting inductor 7*b* and the in-series portion of the primary coil of the transformers. This forms the parallel resonance circuit, and carries out the forming of the high frequency switching wave type to the sine wave.

The current which flows in load circuit 7 is minimized by the parallel resonance circuit. Therefore, while current capacity of circuit parts is made as small as possible and is made cheap, power conversion efficiency is raised.

The load circuit 7 shown in FIG. 17 differs from the one shown in FIG. 4 in that there is connected a capacitor 7*e* in parallel with the primary coil of the transformers 7*d*', forming a parallel resonance circuit.

Figure 18:
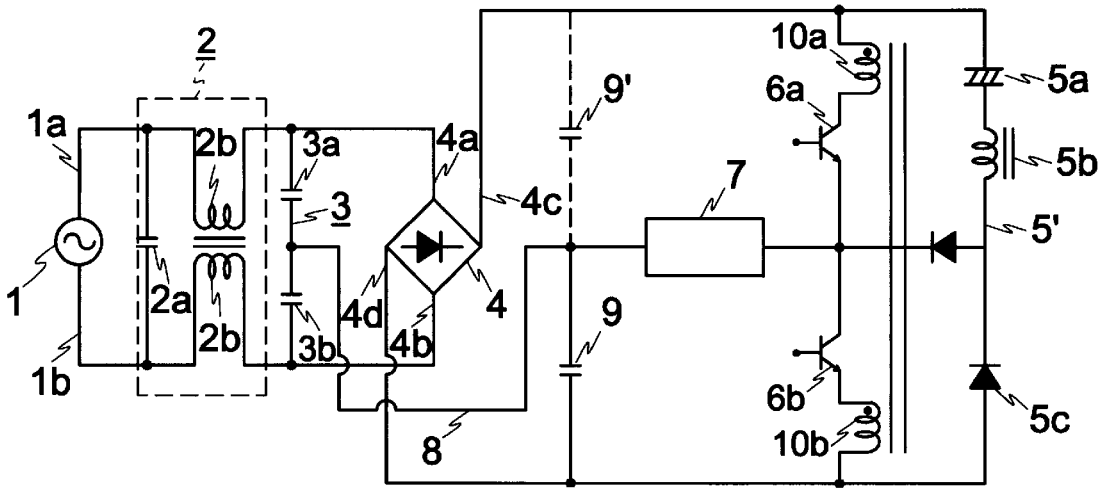
FIG. 18 is a circuit diagram of a fourth embodiment of a lighting circuit according to the present invention.

FIG. 18 is a circuit diagram showing a fourth embodiment of the lighting circuit of the present invention. Common elements will not be further explained. In addition to the push-pull driving by a pair of inductors 10*a* and 10*b*, this embodiment uses partial smoothing circuit as smoothing circuit 5'.

Figure 19:
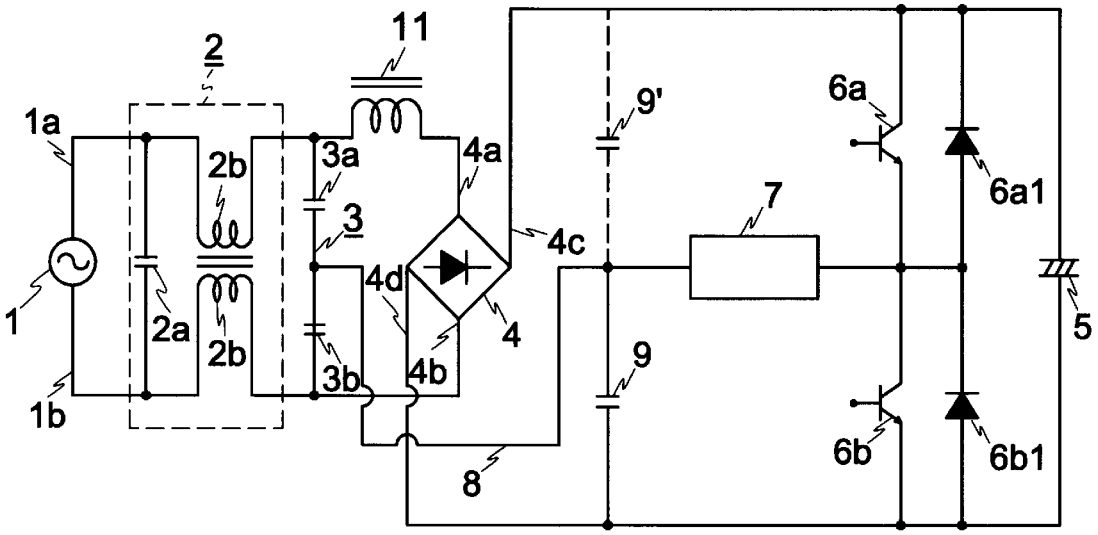
FIG. 19 is a circuit diagram of a fifth embodiment of the lighting circuit of the present invention.

FIG. 19 is a circuit diagram showing the fifth embodiment of the lighting circuit of the present invention. This embodiment includes an inductor 11 coupled between capacitor 3*a* and diode 4A. By using inductor 11, a step-up chopper is formed which increases the high frequency voltage which is applied to load circuit 7. When switching element 6*a* turns ON, inductor 11, switching element 6*a*, load circuit 7, and capacitor 3*a*, form a closed circuit and the step-up chopper action is performed. When second switching element 6*b* turns ON, inductor 11, capacitor 3*a*, load circuit 7, switching element 6*b*, and parallel diode 6*a*1 form a closed circuit, and the step-up chopper action is performed. Consequently, since the terminal voltage of the smoothing capacitor of the smoothing element 5 becomes higher than the DC output voltage of the full wave rectifier 4, charge current to the smoothing capacitor of the smoothing element 5 by the capacitor input from the full wave rectifier 4 does not flow.

Figure 20:
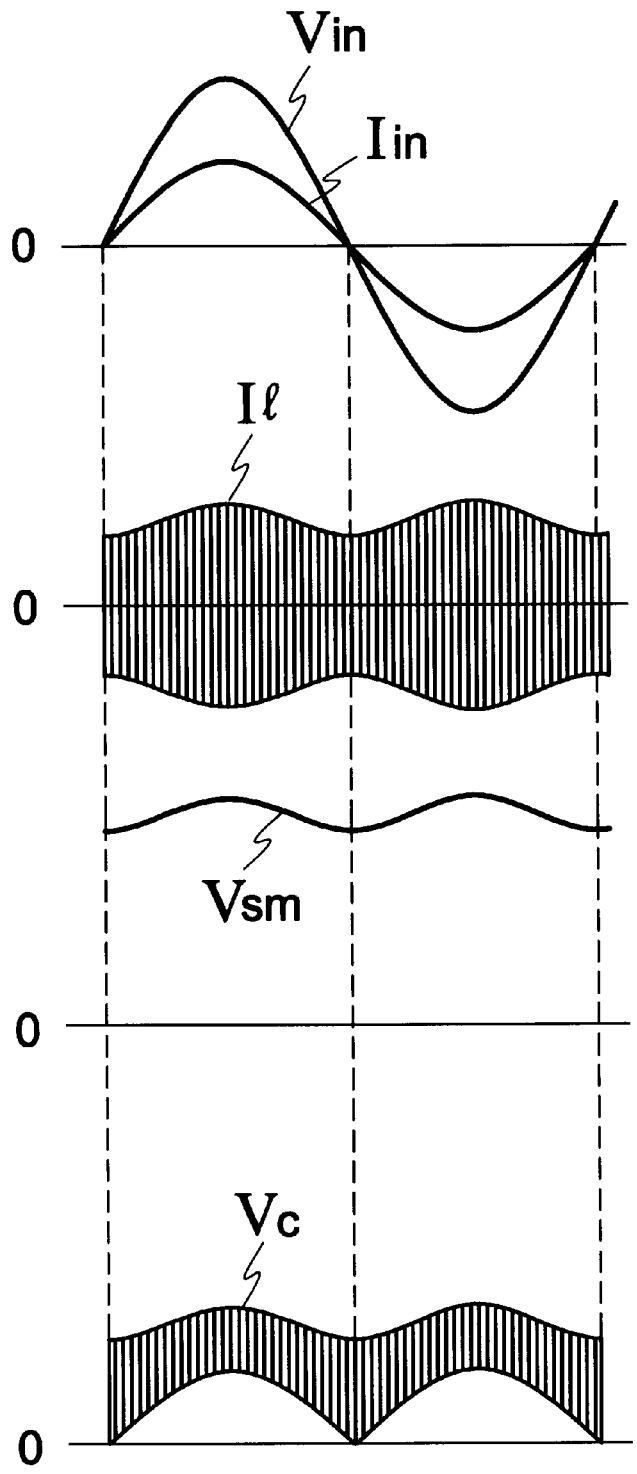
FIG. 20 is a wave form chart explaining the operation of the fifth embodiment of the lighting circuit.

FIG. 20 is a wave form chart explaining the fifth embodiment by showing various voltages and currents of the lighting circuit. Vin is low frequency AC power supply voltage. Iin is AC input current. Il is lamp current. Vsm is the terminal voltage of the smoothing capacitor. Vc is the terminal voltage of the capacitor 9.

Figure 21:
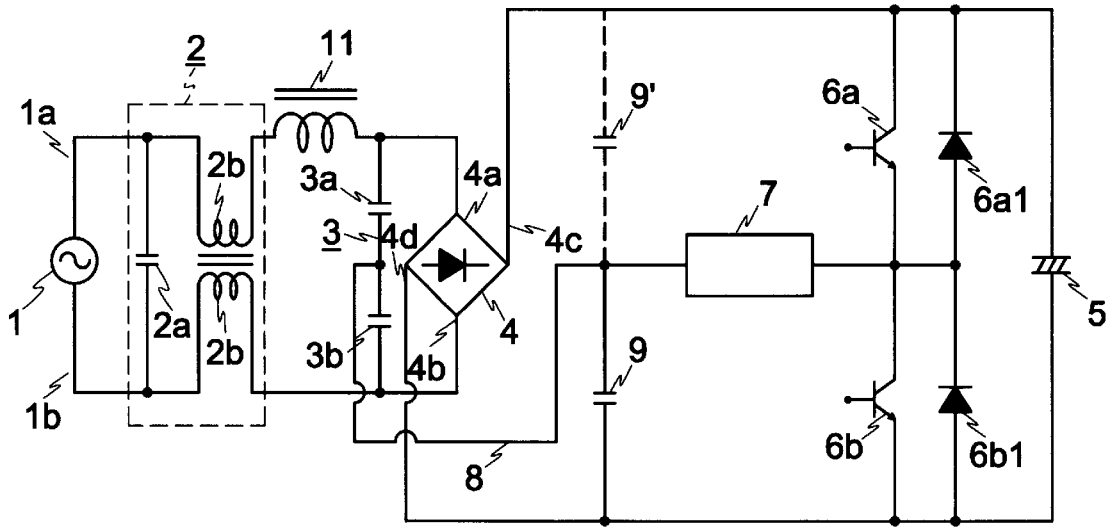
FIG. 21 is a circuit diagram of a sixth embodiment of a lighting circuit of the present invention.
Figure 22:
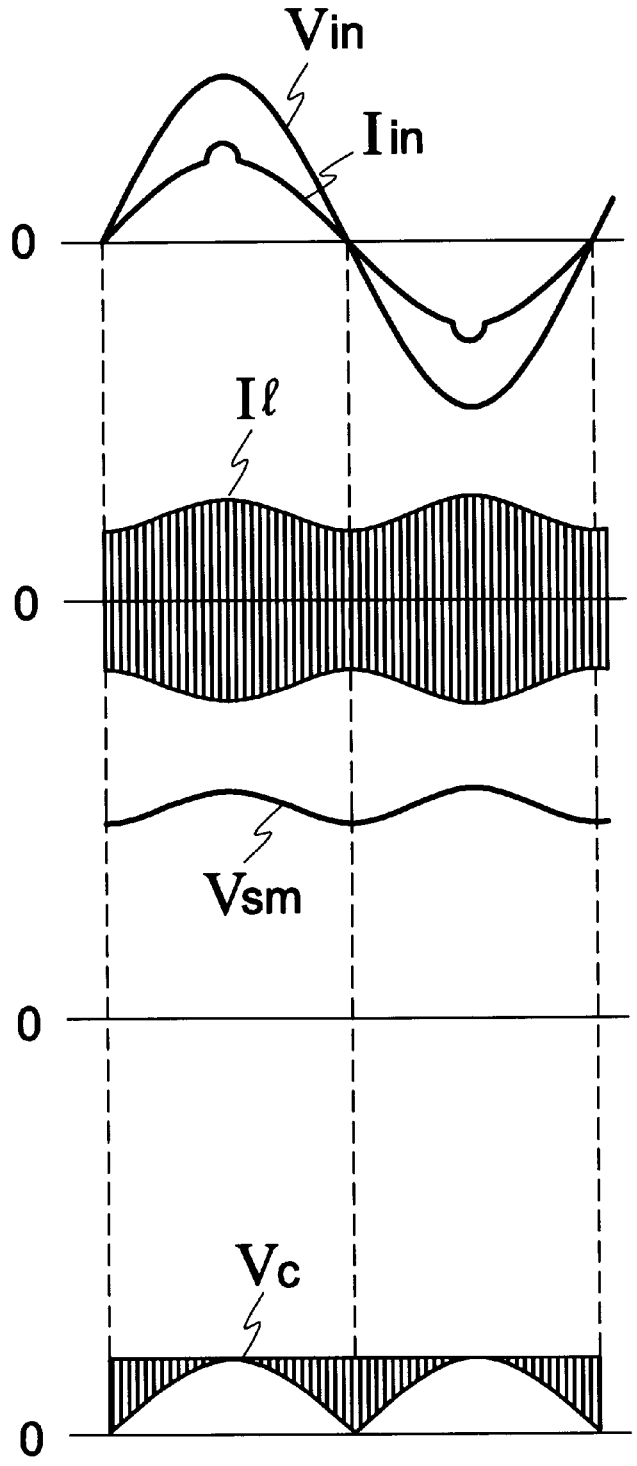
FIG. 22 is a wave form chart explaining the operation of the sixth embodiment.

FIG. 21 is a circuit diagram showing a sixth embodiment of the lighting circuit of the present invention. FIG. 22 is a wave form chart showing the voltage of each part, and current wave type similarly. These figures differ somewhat from their corresponding arrangements shown in FIGS. 19 and 20.

Inductor 11 is connected between the in-series circuit 3 of capacitors 3*a* and 3*b*, and the noise filter 2. inductor 11, connected in this manner, does not cause a step-up chopper to be formed. The terminal voltage Vc of capacitor 9 turns into the voltage of the peak value of low frequency AC power supply voltage, and the same value. Since step-up is not performed for the above-mentioned reason, the terminal voltage of the smoothing capacitor of the smoothing element 5 becomes low, and charge current of capacitor input form flows into the smoothing capacitor in the term when DC output voltage is higher than the terminal voltage of the smoothing capacitor. For this reason, the wave form of AC input current Iin turns the bottom wave type of projection small near the peak value of the sine wave. Note the flat top portion of Vc in FIG. 22 and the "bumps" in the Iin curve of FIG. 22.

Figure 23:
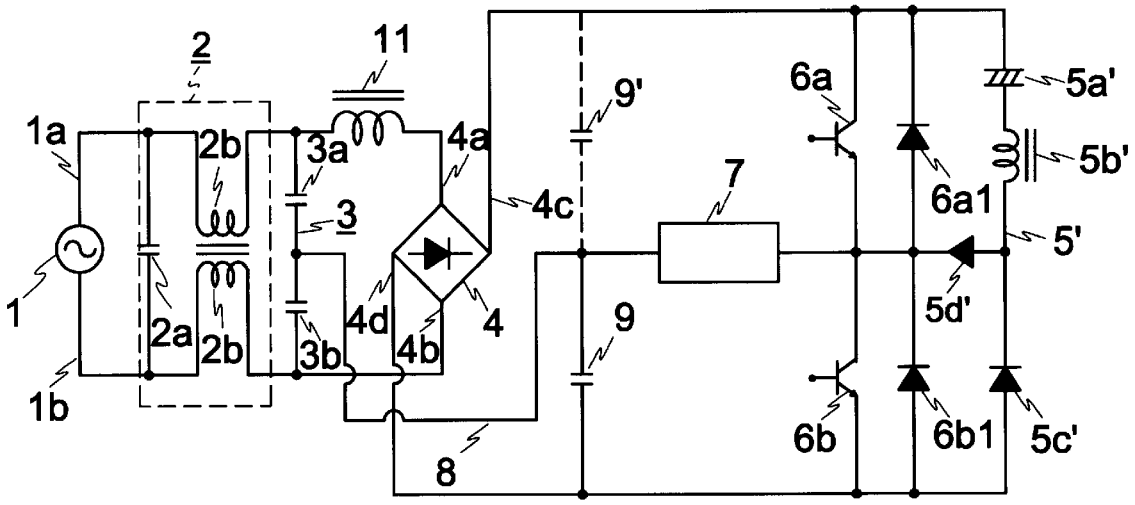
FIG. 23 is a circuit diagram of a seventh embodiment of a lighting circuit of the present invention.
Figure 24:
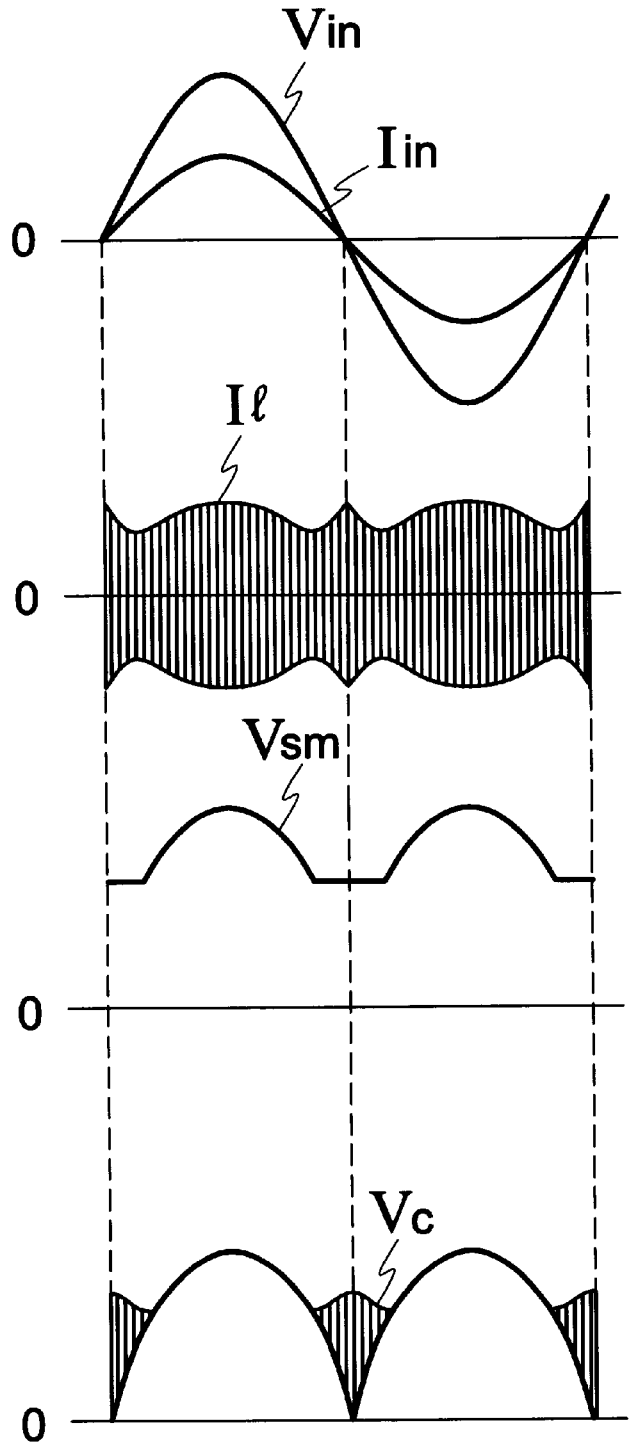
FIG. 24 is a wave form chart explaining the operation of the seventh embodiment.

FIG. 23 is a circuit diagram showing a seventh embodiment of the lighting circuit. FIG. 24 is a wave form chart explaining its operation by showing various voltages and currents. These arrangements are different from those shown in FIGS. 19 and 20, respectively in some respects. This embodiment uses the partial smoothing circuit as smoothing element 5'.

Figure 25:
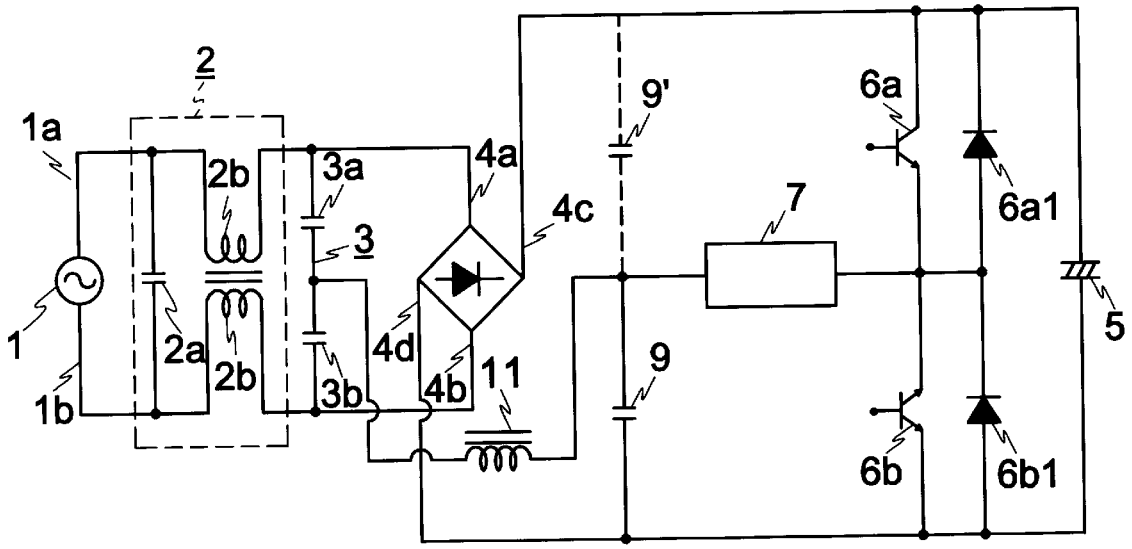
FIG. 25 is a circuit diagram of an eighth embodiment of a lighting circuit of the present invention.

FIG. 25 is a circuit diagram of an eighth embodiment of a lighting circuit according to the invention. It differs somewhat from the circuit shown in FIG. 19. Inductor 11 is inserted in the in series into the high frequency current passage 8. Otherwise the circuit arrangement is the same as that of FIG. 19. By providing the inductor in the high frequency current passage in is series, the inductor resonates to high frequency vibration of both ends of capacitor 9, and produces high frequency voltage. Capacitor 9 acts like a switching element and the same action occurs as with the step-up chopper with the diode connected in parallel with the inductor and the first and second switching element is performed.

Figure 26:
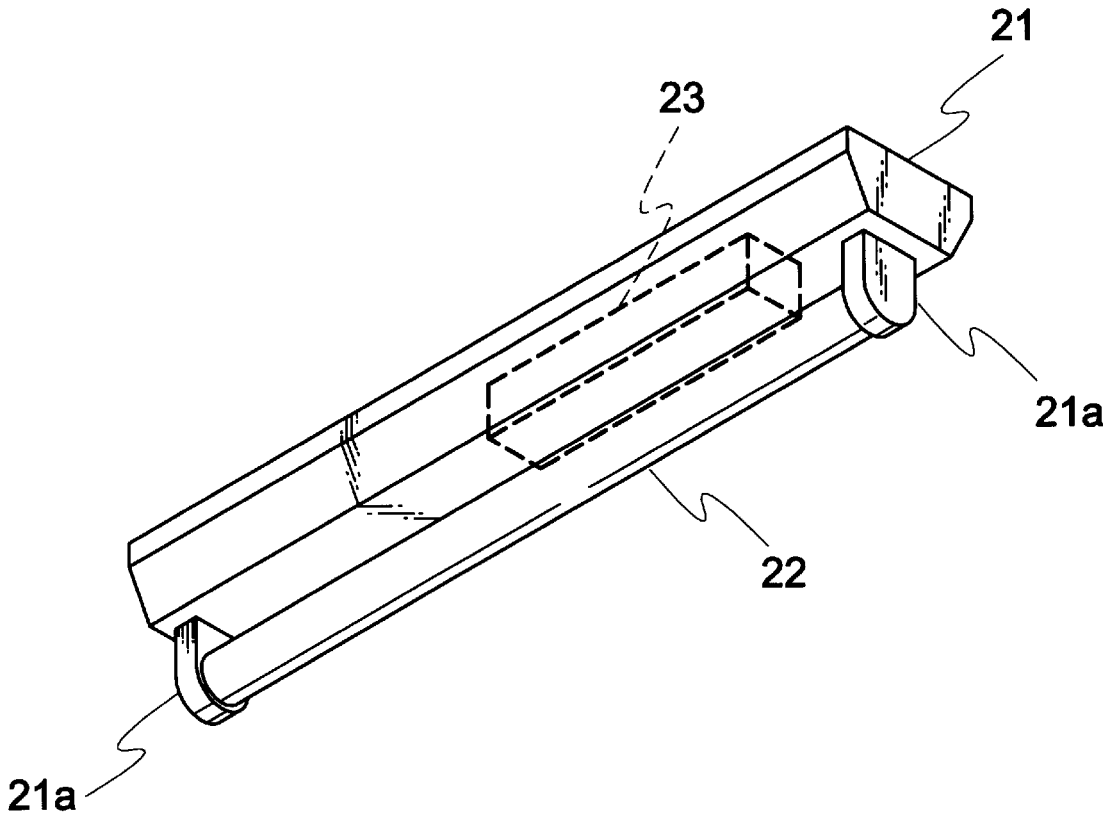
FIG. 26 is a perspective diagram showing a lighting fixture including a lighting device according to the present invention.

FIG. 26 is a perspective diagram showing a lighting fixture according to the invention. A main part 21 contains a lighting circuit 23. It is equipped with a lamp socket 21*a* etc.

Although the discharge lamp 22 comprises part of the lighting circuit, it is supported by the lighting device main part 21 by equipping lamp socket 21*a*. Lighting circuit 23 forms the circuit portion in the lighting device main part 21. As used herein, the term "lighting device" includes any equipment using a luminescent discharge lamp. Examples are scanner, display equipment, ultraviolet ray generating equipment, self ballasted fluorescent lamp, etc. Moreover, the portion of the rest excluding the lighting circuit 23 from the lighting device, is said in the lighting device main part 21.

While the invention has been described in connection with what are presently considered to be the most practical and preferred embodiments, it is to be understood that the invention is not limited to the disclosed embodiments. On the contrary, it is intended to cover various modifications and equivalent arrangements included within the spirit and scope of the appended claims.

What is claimed is:

1. A lighting circuit comprising:

a noise filter having input terminals arranged for connection to a low frequency AC power supply and having output terminals;

a series circuit including first and second capacitors, joined at a node therebetween, the series circuit being connected across output terminals of the noise filter;

a full wave rectifier circuit having an input connected to the output terminals of the noise filter and having first and second DC output terminals;

a smoothing element connected across the DC output terminals of the full wave rectifier;

a load circuit, which has first and second ends, having a discharge lamp with electrodes, a first current limiting inductor and a capacitor connected in parallel with the electrodes;

a first switching element connecting the first DC output terminal of the full wave rectifier with the first end of the load circuit;

a second switching element connecting the second DC output terminal of the full wave rectifier with the first end of the load circuit;

means for driving the first and second switching elements to open and close alternately;

a high frequency current passage for conducting high frequency current from the second end of the load circuit to the node connecting the first and second capacitors; and a fourth capacitor connected between the second end of the load circuit and a DC output terminal of the rectifier.

2. A lighting circuit according to claim 1 wherein the first and second capacitors have substantially equal capacitance.

3. A lighting circuit according to claim 1 wherein the current limiting inductor and capacitor of the load circuit operate as a filament heating circuit of a discharge lamp.

4. A lighting circuit according to claim 1, further comprising a capacitor connected from the second end of the load circuit to the other DC output terminal of the full wave rectifier.

5. A lighting circuit according to claim 1, wherein the smoothing element is a smoothing capacitor.

6. A lighting circuit according to claim 1 wherein the smoothing element comprises:

a smoothing capacitor having a first end connected to the first DC output terminal of the full wave rectifier;

an inductor having a first end connected to the second end of the smoothing capacitor;

a first diode having a cathode connected to the second end of the inductor and an anode connected to the second DC output terminal of the full wave rectifier; and a second diode having an anode connected to the node joining the first diode and inductor and a cathode connected to the second switching element.

7. A lighting circuit as set forth in claim 1, wherein, the load circuit further includes a second inductor magnetically coupled to the first inductor, the first and second inductors forming a transformer.

8. A lighting circuit as set forth in claim 1, further comprising an inductor coupling the output of the noise filter to the AC input of the full wave rectifier.

9. A lighting device comprising:

a frame structure and a lighting circuit contained within the frame structure, the lighting circuit comprising:

a noise filter having input terminals arranged for connection to a low frequency AC power supply and having output terminals;

a series circuit including first and second capacitors, joined at a node therebetween, the series circuit being connected across output terminals of the noise filter;

a full wave rectifier circuit having an input connected to the output terminals of the noise filter and having first and second DC output terminals;

a smoothing element connected across the DC output terminals of the full wave rectifier;

a load circuit, which has first and second ends, having a discharge lamp with electrodes, a first current limiting inductor and a capacitor connected in parallel with the electrodes;

a first switching element connecting the first DC output terminal of the full wave rectifier with the first end of the load circuit;

a second switching element connecting the second DC output terminal of the full wave rectifier with the first end of the load circuit;

means for driving the first and second switching elements to open and close alternately;

a high frequency current passage for conducting high frequency current from the second end of the load circuit to the node connecting the first and second capacitors; and a fourth capacitor connected between the second end of the load circuit and a DC output terminal of the rectifier.

* * * * *